US005496479A

United States Patent [19]

Videau et al.

[11] Patent Number: 5,496,479

[45] Date of Patent: Mar. 5, 1996

[54] COMPOSITIONS FOR AQUEOUS MACHINING FLUIDS AND CYCLODEXTRIN AND FATTY SUBSTANCE BASED AQUEOUS MACHINING FLUIDS

[75] Inventors: Didier Videau, Lille; Serge Gosset, Lestrem, both of France

[73] Assignee: Roquette Freres, Lestrem, France

[21] Appl. No.: 367,253

[22] PCT Filed: Jul. 5, 1993

[86] PCT No.: PCT/FR93/00688

§ 371 Date: Jan. 6, 1995

§ 102(e) Date: Jan. 6, 1995

[87] PCT Pub. No.: WO94/01518

PCT Pub. Date: Jan. 20, 1994

[30] Foreign Application Priority Data

Jul. 7, 1992 [FR] France ..... 92 08372

[51] Int. Cl.[6] ..... C10M 173/00

[52] U.S. Cl. ..... 252/49.3; 252/49.5; 252/52 R; 72/42

[58] Field of Search ..... 252/49.3

[56] References Cited

U.S. PATENT DOCUMENTS 3,314,884 4/1967 Cover ..... 252/10

FOREIGN PATENT DOCUMENTS 2257712 1/1993 United Kingdom .

*Primary Examiner*—Ellen M. McAvoy
*Attorney, Agent, or Firm*—Larson and Taylor

[57] ABSTRACT

An aqueous machining fluid including at least one fatty substance, at least one cyclodextrin and water is disclosed. Also disclosed is a process for making such machining fluid and a process for using the machining fluid to process workpieces, particularly metal pieces, by means of said aqueous machining fluids.

13 Claims, 1 Drawing Sheet

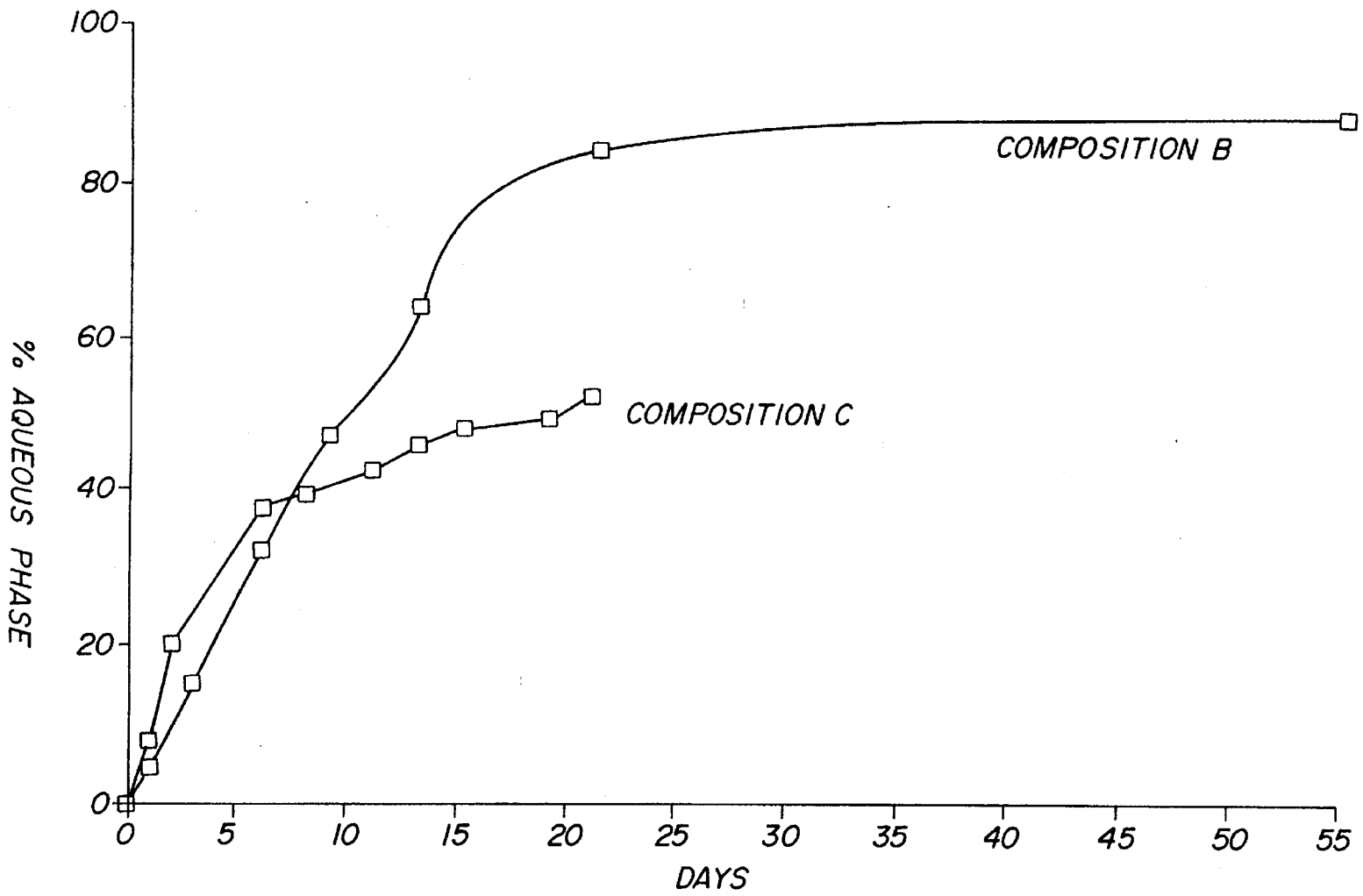
COMPOSITION B
COMPOSITION C
% AQUEOUS PHASE
DAYS
100
80
60
40
20
0
0
5
10
15
20
25
30
35
40
45
50
55

COMPOSITIONS FOR AQUEOUS MACHINING FLUIDS AND CYCLODEXTRIN AND FATTY SUBSTANCE BASED AQUEOUS MACHINING FLUIDS

The subject of the present invention is compositions for aqueous machining fluids comprising at least one fatty substance and at least one cyclodextrin.

It is also targeted at aqueous machining fluids prepared using these compositions and the subject is likewise a method for processing workpieces using such fluids.

The two main functions sought for in a cutting fluid are to increase the lifetime of the tool by a lubricating power and by a cooling power and to contribute to the production of a good surface finish by an anti-weld ability.

Other qualities are also required of these fluids, such as protection of the machined workpieces and of the machine tool against corrosion, suitable processing and removal by simple methods, the absence of risks of irritation or toxicity for the user and the absence of an unpleasant smell.

There exist two types of machining fluids, moreover well described in the literature, neat machining fluids and aqueous machining fluids.

Neat machining fluids are anhydrous and mostly consist of fatty substances. They generally have excellent lubricating characteristics.

However, their use results in a number of disadvantages such as the emission of smoke at high temperature, the risk of inflammability, problems of dermatoses caused by their handling, the difficulty in recycling them and, finally, the very cost of these products.

These disadvantages have promoted the development of aqueous machining fluids.

The latter, by virtue of the high specific heat of the water which they contain, have a cooling capacity which is better than that of neat fluids.

They additionally have a sufficient lubricating power and a low cost.

Moreover, their tendency to cause developments of corrosion on worked workpieces and tools can be easily contained by the use of suitable anticorrosion agents.

Aqueous fluids are consequently preferred to neat fluids.

Aqueous fluids are divided into three categories: soluble fluids, semi-synthetic fluids and synthetic fluids.

Soluble or emulsifiable fluids are generally provided in the form of a milky emulsion.

Semi-synthetic fluids are provided in the form of a translucent microemulsion or pseudoemulsion which becomes opaque during use.

Finally, synthetic fluids are transparent solutions which, in contrast to the two preceding categories, do not contain inorganic oil or synthetic oil.

As regards the first two categories, their formulation requires the presence of emulsifying agents in order to obtain stable and efficient fluids.

The use of these emulsifying agents poses a significant problem during the reprocessing of these fluids. In fact, they resist the breaking of the emulsion, which is an essential stage in this recycling. Now, metal working produces an amount of waste which is among the most significant of those in industry, this waste moreover being among the most difficult to reprocess.

In addition, certain emulsifying agents commonly used represent a risk of irritation for the operator.

In order to limit frictions between the tool and the chip, to increase the lifetime of the tools and to contribute to improving the surface finish of machined workpieces, machining fluids, and in particular aqueous machining fluids, can have various additives added such as, for example, lubricity agents, anti-wear agents and/or extreme pressure agents.

More particularly, extreme pressure (hereinafter known as EP) additives have the role of reducing the risks of seizure between surfaces, under very severe friction conditions and at high temperatures, by the formation of a protective film which is steadily removed from the surfaces.

These EP compounds are most often organosulfur, organochlorine or organophosphorus chemical compounds and/or combinations of these compounds, chlorinated paraffins being the min EP additives used. Their use is, however, limited in practice by the risks of corrosion and toxicity which result from the formation of chlorine in the presence of water.

Moreover, the extreme pressure additives, whether they are chlorine-, sulfur-, or phosphorus-containing compounds, have the major disadvantage of polluting the environment, which results, for this reason, in high processing costs in order to remove them.

The aim of the invention is to overcome the disadvantages of the aqueous machining fluids of the prior art and the subject of the invention is compositions for aqueous machining fluids which make it possible to prepare and to obtain aqueous machining fluids which are high performing and which correspond to all the requirements of practice.

The single FIGURE shows the evolution of phase separation of the machining fluids according to the invention after storage for a few days.

BRIEF DESCRIPTION OF THE DRAWING

The compositions for aqueous machining fluids in accordance with the invention are characterized in that they comprise at least one fatty substance and at least one cyclodextrin.

Within the context of the present invention, the term "fatty substance" denotes any oil or fat which is liquid, solid or pasty at room temperature, whether it is of plant, animal, mineral or synthetic origin or whether it is used as it is or chemically modified, as well as any extract resulting from one of these fatty substances such as, for example, phytosterols, cholesterol, undecylenic acid or alternatively a mixture of a number of these compounds.

The said fatty substance is preferably a fatty acid ester or salt or a mixture of fatty acid esters and/or of fatty acid salts of plant origin.

Within the context of the invention, the term "cyclodextrin" is understood to mean α-, β- or γ-cyclodextrin, or their mixtures, as well as the derivatives of these cyclodextrins. It may be recalled that α-, β- and γ-cyclodextrin are microcycles containing respectively six, seven and eight glucose units. The term "derivative" must be understood as comprising any macrocycle as just defined in which at least one of the consituent glucose units is substituted, at least at one point, by a group or a molecule which can be of very diverse size and functionality, such as, for example, an alkyl or hydroxyalkyl group, and especially a hydroxypropyl group, or a mono- or disaccharide molecule such as a maltose, glucose, fructose or sucrose molecule. The term "derivative" also encompasses cyclodextrin "polymers" obtained, for example, by reaction of cyclodextrins with polyfunctional reactants.

Use is preferably made, within the context of the invention, of at least one cyclodextrin chosen from the group consisting of α-cyclodextrin and β-cyclodextrin and their derivatives. The use of β-cyclodextrin (hereinafter denoted BCD) appears particularly advantageous.

The composition for aqueous machining fluids according to the invention comprises from 5 to 99.5%, preferably from 30 to 99% and more preferentially still from 50 to 95% of fatty substance and from 0.5 to 95%, preferably from 1 to 70% and more preferentially still from 5 to 50% of cyclodextrin, these percentages being expressed by weight on a dry basis.

This composition is preferably provided in a concentrated form, in order to make it easier to store it and to transport it to the places of use. The amount of water present in the composition does not constitute a particularly significant parameter and the preparation of the composition in accordance with the invention in the absence of water can even be envisaged, the water required for constituting the aqueous machining fluids themselves only being added during the stage of preparation of the said fluids. However, it is preferable to prepare the composition in accordance with the invention in the form of a homogeneous suspension or dispersion containing a certain amount of water, generally between 22 and 70% by weight and preferably between 30 and 60% by weight.

The various additives generally used in machining fluids, such as corrosion inhibitors, thickening agents, antifoam agents, wetting agents, bactericidal and/or fungicidal agents and extreme pressure agents, can be entirely or partially added from the stage of the preparation of the compositions, or they can be incorporated during the final preparation of the aqueous machining fluids.

The aqueous machining fluids in accordance with the invention are prepared from the compositions described above.

This preparation is carried out by vigorously stirring the machining fluid composition, most often after addition of water and, if appropriate, after addition of certain additives in the case where the latter are not already included in the said composition. The stirring time is chosen so as to make it possible to obtain the machining fluids in the form of emulsions. The latter exist in the form of milky emulsions or of microemulsions, in which the cyclodextrin plays the role of emulsifying agent.

As with the machining fluid compositions according to the invention, the amount of water present in the machining fluids in accordance with the invention, thus obtained essentially by diluting, adding additives to and stirring the said compositions, does not constitute a particularly significant parameter. However, it is necessary to ascertain that the machining fluids contain a sufficient amount of water to be able to ensure that the fatty substance is emulsified by the cyclodextrin compound.

In addition, the amount of water present in the machining fluids varies depending on the operation for which these fluids are intended, cutting operations requiring fluids which are less concentrated than in deformation operations, for example. The amount of water present in the machining fluids according to the invention is most generally between 22% and 99%, preferably between 30 and 99% and more preferentially still between 35% and 98%.

One of the advantages of the use, in accordance with the invention, of a cyclodextrin in the constitution of the aqueous machining fluids lies in the fact that it is possible to obtain a substantially equivalent lubricating ability while slightly reducing the amount of fatty substance and correspondingly increasing the amount of water.

Moreover, the Applicant Company has surprisingly and unexpectedly observed that the aqueous machining fluids in accordance with the invention exist in the form of a metastable emulsion, the technical behavior of which, however, is outstanding and the reprocessing of which, after use, is greatly facilitated.

In addition, these fluids, as with, moreover, all the machining fluid compositions in accordance with the invention, are entirely bacteriologically stable without it being necessary to resort to the presence of bactericidal and/or fungicidal agents, in contrast to the aqueous machining fluids and compositions of the prior art. This very obviously constitutes another advantage, which was not foreseeable, conferred by the present invention. The risks of skin irritations and of allergies often caused by contact with such agents are additionally and consequently greatly reduced or indeed eliminated.

Finally, another outstanding and surprising characteristic of the aqueous machining fluids in accordance with the invention lies in the fact that they exhibit an extreme pressure behavior which is sufficient to make it possible to greatly reduce the amount of extreme pressure agents present.

The use of cyclodextrins has already been proposed in neat fluids such as lubricating compositions and in particular cutting oils; thus, U.S. Pat. No. 3,314,884, granted to Mobil Oil Corp., claims their use in order to improve the behavior of these compositions by virtue of their complexing properties with respect to chemical additives which are introduced therein. In this case, the cyclodextrins have the role of protecting the complexed additives against early degradation (oxidative or bacteriological) and constitute a means for controlling their release.

The emulsifying properties of cyclodextrins and especially of the α, β and γ forms have, moreover, already been described, in particular by K. Shimada et al., in Nippon Shokuhin Kogyo Gakkaishi, Vol. 38, No. 1 (1991).

These properties have been essentially used for formulating cosmetic and food emulsions which absolutely must remain stable at room temperature over a long period. For these cosmetic and food applications, this stability is guaranteed by the use of conventional thickening and/or emulsifying agents.

Now, it was not to the slightest degree obvious that metastable, indeed unstable, emulsions containing a cyclodextrin compound as an emulsifying agent can be used as an aqueous machining fluid and correspond entirely satisfactorily to the requirements of this application, such as, in particular, maintaining the properties, in particular lubricating properties, at the temperatures of use, which can reach 700° C. at the tool and machined workpieces during the machining operation.

Moreover, the instability of these emulsions, which is reflected by a separation into two phases at rest, one essentially oily and the other aqueous, is of outstanding advantage as regards the processing and recycling of these fluids, which today constitute a major preoccupation, as described above.

In addition, cyclodextrin is entirely harmless to the operator, in contrast with conventional emulsifying agents used, and finally the use of the fluids in accordance with the invention is shown to be particularly advantageousunder difficult machining conditions because they make it possible to be freed from all or part of the presence of extreme pressure agents whose harmful effects on the environment are well known.

The aqueous machining fluids according to the invention are prepared according to a simple method which does not require any expensive and/or complex equipment or technical means, which constitutes another advantage of the invention.

They can be used in methods for processing workpieces, in particular metal workpieces, which consist in machining these workpieces with simultaneous flooding of the active part of the tool with an aqueous machining fluid containing at least one fatty substance and at least one cyclodextrin, in then recovering the fluid at the end of the machining operation, in allowing it to stand for the time necessary for separation of the phases to take place, in recovering each of the phases, in filtering them in order to remove the suspended impurities and finally in recycling them according to an appropriate regeneration processing.

The aqueous machining fluids according to the invention thus constitute novel industrial products having undeniable advantages with respect to conventional aqueous machining fluids.

They simultaneously make possible better cooling, better lubrication under difficult machining conditions and recycling costs decreased by the absence, or at the very least by the presence in a smaller amount, of sulfur-containing, chlorine-containing or phosphorus-containing extreme pressure agents and have good resistance to bacterial or fungal growth.

Moreover, as cyclodextrins result from renewable plant matter, namely amylaceous matter, their biodegradability and their nontoxicity make them products which are entirely tolerated by the environment.

Moreover, if a fatty substance of plant or animal origin is chosen, the aqueous machining fluids according to the invention have a biodegradable nature.

The compositions for aqueous machining fluids and the aqueous machining fluids according to the invention are used in all machining operations, especially of metals, whether they are cutting (skiving operation, milling operation, and the like) or deformation (stamping, drawing, rolling, and the like) operations. They can also be used in operations for the temporary protection of the surfaces of objects such as automobile parts, pipes, aluminum frames, molded articles and others, which consist essentially in applying a protective coating to them, generally in the form of a film or a thin layer, which can be removed at the time of sale or just before use.

The invention can be still better understood using the examples which follow and which report certain particularly advantageous embodiments, which examples, however, are given without any implied limitation.

EXAMPLES

1. Preparation of Compositions and of Aqueous Machining Fluids According to the Invention Two compositions according to the invention are prepared in the following way:

The following are successively added to a turbine homogenizer already containing 80 liters of demineralized water preheated to 30° C.:

β-cyclodextrin, with stirring, until completely diluted, the β-cyclodextrin used being that marketed by the Applicant Company under the trade name Kleptose, an oil, the mixture obtained being kept stirring until an emulsion is obtained, a corrosion inhibitor, stirring then being maintained for approximately fifteen minutes.

The compositions thus obtained exist in the form of concentrated emulsions. Two machining fluids A and B are prepared from these compositions, by diluting each of the two fluids with 70 liters of demineralized water.

The surface tension is then, if appropriate, adjusted by addition of a tall oil fatty acid saponified with triethanolamine, so as to obtain a surface tension of approximately 35 mN/m.

Finally, xanthan gum is added and the volume is adjusted with demineralized water.

The formulations of two aqueous fluids according to the invention, A and B, are collated in Table I.

TABLE I

| FORMULATIONS | TRADENAME | A % BY WEIGHT | B % BY WEIGHT |
|---|---|---|---|
| Mineral oil | Enerpar (BP) | 4.07 | — |
| Vegetable oil | Metiloil A (ATO) | — | 4.12 |
| β-Cyclodextrin | Kleptose (Roquette) | 1.4 | 2.04 |
| Corrosion inhibitor | Lubrizol 5329 (Lubrizol) | 1.05 | 1.01 |
| Xanthan gum | | 0.09 | 0.09 |
| Tall oil soap | (Daudruy) | — | 0.06 |
| Water | | 93.39 | 92.68 |
| Surface tension | | 40 mN/m | 35 mN/m |

The cutting off fluid which will be taken as reference below (REF. 1) is an emulsifiable mineral oil which forms, with water, a milky emulsion which is stable with time. It contains anticorrosion, rust-prevention, antifoam and extreme pressure additives. Its dry matter content is 3%.

2. Evaluation of the Technical Behavior of the Machining Fluids According to the Invention The machining fluids A and B in accordance with the invention are tested in skiving operation.

The skiving tests are carried out on a Manurhin-type Combimat 42 headstock single-spindle automatic lathe.

The operations carried out over a 6-hour production are the following: drilling, turning, tapping, chamfer boring, groove boring (1.5 mm), threading, V-shaped-groove boring and cutting off.

Tolerance criteria are preestablished for each operation regarding the diameter, thread pitch, coaxiality, roughness or visual appearance of the workpieces. On the tools, the lifetime, by evaluation of the failure of the cutting edge, and the wear are measured.

On the chips, fragmentation is evaluated the quality of the lubrication and of the cooling are thus judged from their appearance. In fact, depending on whether they are straight and long, entangled, in the form of a large-diameter helix or of a small-diameter helix, straight and short, arc-shaped, spiral-shaped, needle-shaped or particle-shaped, the quality of the workpieces will be different.

The machined steel is a steel of weakly-alloyed construction, 18 CD4U, supplied by Ascometal.

a. For turning, V-shaped boring, cutting-off or groove boring operations, the criterion studied was the roughness of the machined workpieces.

The roughness is measured using a Perthen M4P surface finish device.

The results obtained with the fluids according to the invention and the reference oil are collated in Tables II, III, IV and V.

These results show that the mean values of the roughnesses obtained with the fluids A and B according to the invention are generally very similar to those obtained with the machining fluid of the prior art.

TABLE II

| | Turning roughness | | |
|---|---|---|---|
| | ROUGHNESS Ra in μm | | |
| COMPOSITION | MINI | MAXI | MEAN |
| REF. 1 | 2.5 | 7.6 | 4.2 |
| A | 2.5 | 5.3 | 3.3 |
| B | 1.8 | 3.9 | 2.5 |

TABLE III

| | V-shaped boring roughness | | |
|---|---|---|---|
| | ROUGHNESS Ra in μm | | |
| COMPOSITION | MINI | MAXI | MEAN |
| REF. 1 | 2.7 | 10 | 6.6 |
| A | 4.3 | 8 | 6.0 |
| B | 5.8 | 9 | 7.3 |

TABLE IV

| | Cutting-off roughness | | |
|---|---|---|---|
| | ROUGHNESS Ra in μm | | |
| COMPOSITION | MINI | MAXI | MEAN |
| REF. 1 | 1.9 | 6.2 | 3.8 |
| A | 3.6 | 7.5 | 5.1 |
| B | 1.8 | 3.8 | 2.8 |

TABLE V

| | Boring roughness, 15° cone | | |
|---|---|---|---|
| | ROUGHNESS Ra in μm | | |
| COMPOSITION | MINI | MAXI | MEAN |
| REF. 1 | 4.5 | 5.6 | 5.2 |
| A | 4.6 | 7.4 | 6.0 |
| B | 4 | 7.5 | 6.1 |

b. Notation of the chips

For each of the operations, the chips obtained were assessed. The description of the appearance of the chips and the assessments have been collated in Table IV [sic]

TABLE VI

| | OPERATION | PEARLING [sic] | TURNING | BORING, 15° CONE | GROOVE BORING | CUTTING OFF | V-SHAPED BORING |
|---|---|---|---|---|---|---|---|
| REF. 1 | DESCRIPTION OF THE CHIPS | long helix of small ϕ, short cyl. helix | short cyl. helix | short conical coil | short cyl. helix | long helix of small ϕ, short cyl. helix | spiral |
| | ASSESSMENT | poor to acceptable | acceptable | acceptable | acceptable | poor to acceptable | good |
| A | DESCRIPTION OF THE CHIPS | short cyl. helix | short cyl. helix | short conical coil | spiral | short cyl. helix | spiral |
| | ASSESSMENT | acceptable | acceptable | acceptable | good | acceptable | good |
| B | DESCRIPTION OF THE CHIPS | short cyl. helix | short cyl. helix | conical coil | spiral | short cyl. helix | spiral |
| | ASSESSMENT | acceptable | acceptable | acceptable | good | acceptable | good |

The chips obtained with the aqueous machining fluids A and B are of a quality at least equivalent to and often better than that of the chips obtained with the machining fluid of the prior art.

The good quality of the chips obtained with the machining fluids according to the invention clearly demonstrates the entirely satisfactory cooling and lubricating properties of the latter.

c. For the threading and tapping operations, the threads obtained were evaluated.

TABLE VII

| | | TAPPING | THREADING |
|---|---|---|---|
| REF. 1 | THREAD DESCRIPTION | low tearing away on thread flanks | low tearing away on thread flanks |
| | ASSESSMENT | fairly good | fairly good |
| A | THREAD DESCRIPTION | low tearing away on thread flanks | low tearing away on thread flanks |
| | ASSESSMENT | fairly good | fairly good |
| B | THREAD DESCRIPTION | low tearing away on thread flank | low tearing away on thread flanks |
| | ASSESSMENT | fairly good | fairly good |

With respect to the appearance of the threading and tapping threads, after examination of the machined workpiece under a microscope, the machining fluids A and B prove to be entirely comparable with those of the prior art.

d. The machining fluids according to the invention and the machining fluids according to the prior art can alternatively be compared in true production and by main operations.

The true production values are calculated in Table VIII.

TABLE VIII

| | NO. OF MACHINED WORKPIECES | PRODUCTION INDEX | INCIDENTS |
|---|---|---|---|
| REF. 1 | 40 | 100% | Tapping tool deaths |
| A | 35 | 88% | Tapping tool deaths |
| B | 73 | 182.5% | V-shaped-groove boring tool deaths |

Table VIII demonstrates the number of machined workpieces up to the death of one of the tools, as well as the nature of the failed tool, and gives a classification in terms of behavior of the machining fluids A and B according to the invention with respect to the referenced machining fluid.

The values by main operations are collated in Table IX.

| | % by weight |
|---|---|
| Enerpar mineral oil (BP) | 4.07 |
| Kleptose β-cyclodextrin (Roquette Frères) | 1 |
| Lubrizol 5329 (Lubrizol) | 1.05 |
| Xanthan gum | 0.09 |
| Water | 93.79 |

The method of preparation of this fluid C is identical to that of the fluids A and B.

Thus, it is observed, on the curve relating to the fluid B, that, after standing for 20 days, 80% of the volume of this fluid consists of an aqueous phase, on which thus floats a concentrated oil/BCD emulsion.

Likewise, the curve relating to the fluid C shows that, after standing for 20 days, the aqueous phase represents 50% of the volume of this fluid.

TABLE IX

| COMPOSITION DURATION OF THE TEST (NO. OF MACHINED WORKPIECES) | REF. 1 320 PIECES | | A 320 PIECES | | B 420 PIECES | |
|---|---|---|---|---|---|---|
| OPERATIONS | NO. OF MACHINED WORKPIECES | CAUSE OF THE INCIDENT | NO. OF MACHINED WORKPIECES | CAUSE OF THE INCIDENT | NO. OF MACHINED WORKPIECES | CAUSE OF THE INCIDENT |
| DRILLING | 320 | | 320 | | 420 | |
| TURNING | 165 | outside size tolerance | 130 | tool death | 160 | tool death |
| TAPPING | 40 | tool death | 35 | tool death | 120 | tool death |
| 1.5 GROOVE BORING | 75 | outside size tolerance | 95 | tool death | 420 | |
| V-SHAPED-GROOVE BORING | 123 | tool death | 95 | tool death | 73 | tool death |
| CUTTING OFF | 149 | tool death | 70 | outside roughness tolerance tool death | 210 | tool death |

It is thus observed that, on the criteria of tool ruptures, the fluid A in accordance with the invention, in comparison with the fluid according to the prior art, makes possible savings in productivity in 1.5 groove boring and good results in drilling.

It is also observed that, still on the criterion of tool ruptures, the fluid B according to the invention, in comparison with the machining fluid according to the prior art, makes possible savings in productivity in drilling, tapping, 1.5 groove boring and cutting off, and equivalent behavior in turning.

3. Reprocessing of the Machining Fluids According to the Invention

The machining fluids according to the invention have the advantage of exhibiting spontaneous separation of phases after storage for a few days.

This is illustrated by the curves displayed in FIG. 1, obtained for two aqueous machining fluids according to the invention: the fluid B, the composition of which has already been given in Table I, and the fluid C, the composition of which is the following:

Each of the phases can thus easily be recovered in order to be filtered.

The concentrated supernatent emulsion is then broken using known means: these can be a chemical (emulsion breaker such as sulfuric acid), mechanical, enzymatic and/or thermal means.

Thus, the supernatent emulsions of the fluids B and C were treated with 1.5% of pure sulfuric acid, then heated at 118° C. for 15 minutes and finally subjected to a centrifugal action (Sorvall RC5C centrifuge—1200 m/s2 [sic]), which made it possible to completely recover the oil.

The oil thus recovered can optionally be reused in the same application.

4. Evaluation of the Microbiological Stability of the Machining Fluids According to the Invention In addition to the technical behavior and the ease of reprocessing of the machining fluids according to the invention, their stability with respect to microorganisms was studied. This stability was monitored on the fluids A and B which do not contain preserving agent, brought into service for approximately six months.

The aqueous machining fluid taken as the reference is obtained by diluting a paraffin oil which contains an extreme pressure additive and a preserving agent. Its dry matter content is 5% (REF. 2).

The number of aerobic germs, molds, yeasts, anaerobic bacteria and sulfate-reducing anaerobic bacteria was evaluated. The values are collated in Table X.

The good stability of the machining fluids according to the invention with respect to microorganisms is observed across this table.

TABLE X

| | AEROBIC GERMS | | | MOLDS | | | YEASTS | | |
|---|---|---|---|---|---|---|---|---|---|
| | REF. 2 MECANOIL S 100 | A | B | REF. 2 MECANOIL S 100 | A | B | REF. 2 MECANOIL S 100 | A | B |
| T0 | DATE ON WHICH THE FLUIDS ARE SIMULTANEOUSLY BROUGHT INTO SERVICE | | | | | | | | |
| T1 = T0 + 4 months | | $<10^3$ | 480 | | <10 | 370 | | <10 | 100 |
| T1 = 16d | $>10^4$ | 170 | 350 | <10 | <10 | 220 | $3\ 10^4$ | <10 | <10 |
| T1 = 30d | $6.1\ 10^6$ | 900 | 4100 | 100 | <10 | 360 | 2500 | <10 | <10 |
| T1 = 45d | $6.4\ 10^6$ | 200 | $<10^6$ | 100 | <10 | 200 | 2700 | <10 | <10 |

| | ANAEROBIC BACTERIA | | | SULFATE-REDUCING ANAEROBIC BACTERIA | | |
|---|---|---|---|---|---|---|
| | REF. 2 MECANOIL S 100 | A | B | REF. 2 MECANOIL S 100 | A | B |
| T0 | DATE ON WHICH THE FLUIDS ARE SIMULTANEOUSLY BROUGHT INTO SERVICE | | | | | |
| T1 = T0 + 4 months | | | | | | |
| T1 = 16d | $3.1\ 10^3$ | 150 | 80 | <10 | 30 | 10 |
| T1 = 30d | $3.2\ 10^3$ | 120 | 10 | <10 | 60 | <10 |
| T1 = 45d | $3\ 10^3$ | 60 | <10 | <10 | 170 | <10 |

5. Evaluation of the Extreme Pressure Characteristics of the Machining Fluids According to the Invention New machining fluids in accordance with the invention are prepared according to a method identical to that used for the fluids A and B.

The formulation of these fluids is given below:

TABLE XI

| FORMULATIONS | TRADE MARK | D % wt | E % wt | F % wt | G % wt |
|---|---|---|---|---|---|
| Vegetable oil | Metiloil (ATO) | 1.79 | 1.62 | — | 4.12 |
| Milk fatty substance extract* | | — | — | 1.75* | — |
| β-cyclodextrin | Kleptose B (Roquette) | 0.88 | 0.8 | 3.25* | 2.04 |
| Corrosion inhibitor | Lubrizol 5323 | 0.26 | 0.23 | 0.60 | 0.6 |
| Xanthan gum | | 0.039 | 0.035 | 0.09 | 0.09 |
| Tall oil soap | Daudruy | 0.026 | 0.023 | — | 0.06 |
| Chlorinated paraffin extreme pressure agent | Anglomol 40 (Lubrizol) | — | 0.27 | — | 0.69 |
| Water | | 97 | 97 | 94.3 | 92.4 |

*The milk fatty substance extract of the fluid F consists essentially of cholesterol, fatty acids and triglycerides obtained according to the technique described, for example, in European Patent Application No. 406,101 and using β-cyclodextrin as extracting agent. According to this technique, the fatty substance extract is mostly found enclosed in the β-cyclodextrin and it is these inclusion compounds which are used as such in the machining fluid F.

The extreme pressure characteristics of the fluids D to G, and of the fluid B, are evaluated according to the Falex method (ASTM standard D3233). The test consists in rotating a steel shaft at 290 revolutions per minute between 2 stationary V-shaped blocks, the assembly being immersed in the formulation to be tested. A load is applied on the V-shaped blocks, this load steadily increasing with an increment of 250 lbs and being kept constant for 1 minute at each increment. The seizing load obtained makes it possible to evaluate the lubricating properties of the tested formulation and its resistance to degradation.

The behaviors of the fluids B, D, E, F and G according to the invention are collated in Table XII.

The two references used here are, on the one hand, the cutting fluid containing an extreme pressure additive REF. 1 and, on the other hand, the cutting fluid containing an extreme pressure additive defined in part 4 and whose dry matter content is now 3% (REF. 3).

TABLE XII

| | REF. 1* | REF. 3* | B | D | E* | F | G* |
|---|---|---|---|---|---|---|---|
| TEST 1 (in lbs) | 2,200 | 1,600 | 1,550 | 1,800 | 1,600 | 1,600 | 1,950 |
| TEST 2 (in lbs) | 2,100 | 1,650 | 1,550 | 1,850 | 1,500 | 1,500 | 1,850 |

*presence of extreme pressure additives.

On reading these results, it is observed that the aqueous machining fluids according to the invention B, D and F, which do not contain extreme pressure additives, behave entirely similarly to the cutting fluids according to the prior art REF. 1 and REF. 3 containing extreme pressure additives.

It is also observed that, for a given dry matter content (approximately 7%), the presence of an extreme pressure additive in the fluid G does not bring about an outstanding improvement in the behavior with respect to that of the fluid B.

Finally, it should be noted that the absence of extreme pressure additives in the fluids according to the invention constitutes an additional advantage because the latter do not develop nauseating smells after a prolonged rest of several days, which smells are characteristic of cutting fluids containing extreme pressure additives.

We claim:

1. Aqueous machining fluid comprising at least one fatty substance, at least one cyclodextrin, and water.

2. Aqueous machining fluid according to claim 1, comprising from 5 to 99.5% of fatty substance and from 0.5 to 95% of cyclodextrin, these percentages being expressed by weight on a dry basis.

3. Aqueous machining fluid according to claim 2, comprising from 30 to 99% of fatty substance and from 1 to 70% of cyclodextrin.

4. Aqueous machining fluid according to claim 3, comprising from 50 to 95% of fatty substances and from 5 to 50% of cyclodextrin.

5. Aqueous machining fluid according to claim 1, wherein the amount of water is between 22 and 99% by weight.

6. Aqueous machining fluid according to claim 5, wherein the amount of water is between 30 and 99% by weight.

7. Aqueous machining fluid according to claim 6, wherein the amount of water is between 35 and 98% by weight.

8. Aqueous machining fluid according to claim 1 comprising one or more additives selected from the group consisting of lubricity agents, anti-wear agents, extreme pressure agents, corrosion inhibitors, thickening agents, antifoam agents, wetting agents, bactericidal agents and fungicidal agents.

9. Aqueous machining fluid according to claim 1, prepared by vigorously stirring a composition comprising at least one fatty substance and at least one cyclodextrin, after addition of water and any optional additives selected from the group consisting of lubricity agents, anti-wear agents, extreme pressure agents, corrosion inhibitors, thickening agents, antifoam agents, wetting agents, bactericidal agents and fungicidal agents.

10. Aqueous machining fluid according to claim 1, which is in the form of an emulsion.

11. Process for processing workpieces, comprising the step of machining of the workpieces with simultaneous flooding of the active part of the tool with an aqueous machining fluid which comprises at least one fatty substance, at least one cyclodextrin, and water.

12. Process according to claim 11, wherein the workpieces are metal workpieces.

13. Process according to claim 11, wherein the machining fluid is recovered at the end of the machining operation and is then left standing in order to obtain a phase separation, the phases so obtained are recovered, filtered in order to remove the suspended impurities, and finally are recycled.

* * * * *